US007441527B2

(12) United States Patent
Hayashi et al.

(10) Patent No.: US 7,441,527 B2
(45) Date of Patent: Oct. 28, 2008

(54) AIR SUCTION DEVICE

(75) Inventors: Kazuhiro Hayashi, Nishikamo-gun (JP); Toshiaki Nakayama, Nishikamo-gun (JP); Masakazu Ozawa, Iwata (JP); Hideaki Itakura, Nagoya (JP); Naoya Kato, Ama-gun (JP); Takanobu Kawano, Obu (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 515 days.

(21) Appl. No.: 11/330,403

(22) Filed: Jan. 12, 2006

(65) Prior Publication Data

US 2006/0159563 A1 Jul. 20, 2006

(30) Foreign Application Priority Data

Jan. 14, 2005 (JP) ..... 2005-007504

(51) Int. Cl.
*F02M 35/10* (2006.01)

(52) U.S. Cl. ..... 123/184.53; 123/184.57; 181/229

(58) Field of Classification Search ..... 123/184.53, 123/184.57; 181/229
See application file for complete search history.

(56) References Cited

U.S. PATENT DOCUMENTS 5,107,800 A * 4/1992 Araki et al. ..... 123/184.57
5,333,576 A * 8/1994 Verkleeren ..... 123/184.53
5,571,239 A * 11/1996 Kameda et al. ..... 123/184.53
5,894,823 A * 4/1999 Lee ..... 123/184.57
6,422,192 B1 * 7/2002 Bloomer ..... 123/184.57
6,609,489 B1 * 8/2003 Slopsema et al. ..... 123/184.57
2007/0044747 A1 * 3/2007 Sawatari et al. ..... 123/184.21
2007/0131189 A1 * 6/2007 Shinada et al. ..... 123/184.57

FOREIGN PATENT DOCUMENTS

JP 8-123435 5/1996
JP 2004-245090 9/2004

* cited by examiner

*Primary Examiner*—Stephen K. Cronin
*Assistant Examiner*—Sizo B Vilakazi
(74) *Attorney, Agent, or Firm*—Nixon & Vanderhye PC

(57) ABSTRACT

An air suction device is provided with an air suction system having at least one capacity-enlarged portion, a compression pump compressing air in synchronization with operation of an engine, a compression air control unit, and a vibration plate which is vibration-excited by air compressed by the compression pump and disposed in a connection passage connecting a discharge side of the compression pump with the capacity-enlarged portion. The compression air control unit controls the phase and amplitude of a pressure variation of compression air discharged from the compression pump, to provide compression air with the pressure variation having the phase opposite to a pressure variation of suction air sucked into the engine.

17 Claims, 7 Drawing Sheets

AIR SUCTION DEVICE

CROSS REFERENCE TO RELATED APPLICATION

This application is based on a Japanese Patent Application No. 2005-7504 filed on Jan. 14, 2005, the disclosure of which is incorporated herein by reference.

FIELD OF THE INVENTION

The present invention relates to an air suction device for an engine (e.g., internal combustion engine), in which noise caused by suction air into the engine is reduced and an air-suction efficiency of the engine is improved.

BACKGROUND OF THE INVENTION

Generally, a noise reduction device is provided for an engine to generate interference sound having an opposite phase to noise caused in an air suction system of the engine, so as to reduce air suction noise of the engine. In this case, it is necessary to generate interference sound in synchronization with the rotation of the engine, so that considerable electric power and a corresponding control apparatus become required.

Referring to JP-2004-245090A, there has been proposed an air-suction noise reducing device which has an air vibration exciting apparatus for vibration-exciting air responding to the operation of the engine.

In this case, air having a varying pressure is supplied for the air vibration exciting apparatus, to vibration-excite air in a suction passage in order to reduce air suction noise of the engine. However, the air pressure is switched by a switching valve, it is difficult to precisely control an amplitude of the air pressure provided for the air vibration exciting apparatus corresponding to noise caused in the air suction system. Moreover, because the switching valve is controlled by a controller, it is difficult to provide the varying pressure of air in synchronization with the rotation of the engine.

SUMMARY OF THE INVENTION

In view of the above-described disadvantages, it is an object of the present invention to provide an air suction device, in which vibration having an opposite phase to that of a pressure variation of suction air in an air suction system of an engine is generated to reduce noise of the engine and increase output thereof.

According to the present invention, an air suction device is provided with an air suction system which defines an air suction passage of an internal combustion engine, at least one capacity-enlarged portion which is positioned at midway of the air suction passage and has an enlarged capacity, at least one compression pump which compresses air in synchronization with operation of the engine, a compression air control unit, and a vibration plate which is vibration-excited by air compressed by the compression pump and disposed in a connection passage connecting a discharge side of the compression pump with the capacity-enlarged portion. The compression air control unit controls at least one of a phase and a amplitude of a pressure variation of compression air discharged from the compression pump, to provide compression air with the pressure variation having the phase opposite to that of a pressure variation of suction air sucked into the engine.

In this case, the vibration plate is vibration-excited by air compressed by the compression pump. The pressure of compression air is heightened so the vibration plate can be provided with large vibration corresponding to large noise in the air suction system. The compression air control unit provides the pressure variation having the opposite phase to the pressure variation of suction air into the engine, for compression air discharged from the compression pump. Therefore, the pressure variation of compression air discharged form the compression pump can be readily controlled responding to the pressure variation of suction air in the air suction passage.

Because air discharged fro the compression pump vibration-excites the vibration plate which is arranged in the connection passage communicated with the capacity-enlarged portion of the air suction passage, the vibration of the vibration plate is transmitted into the capacity-enlarged portion where noise caused by air suction into the engine is reflected. Thus, noise in the air suction passage can be efficiently reduced.

Moreover, suction air in the air suction passage is forced into the engine due to the vibration of the vibration plate. Thus, the pressure of suction air in the air suction passage is increased, so that the capacity efficiency of air sucked into the engine is increased.

Accordingly, vibration having the opposite phase corresponding to the pressure variation of suction air in the air suction system can be precisely generated. Thus, noise in the air suction system can be reduced, and the output of the engine can be improved.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS

First Embodiment

An air suction device 10 according to a first embodiment of the present invention will be described with reference to FIGS. 1-5. The air suction device 10 is arranged at an air suction side of an engine, for example, an internal combustion engine (not shown).

Figure 1:
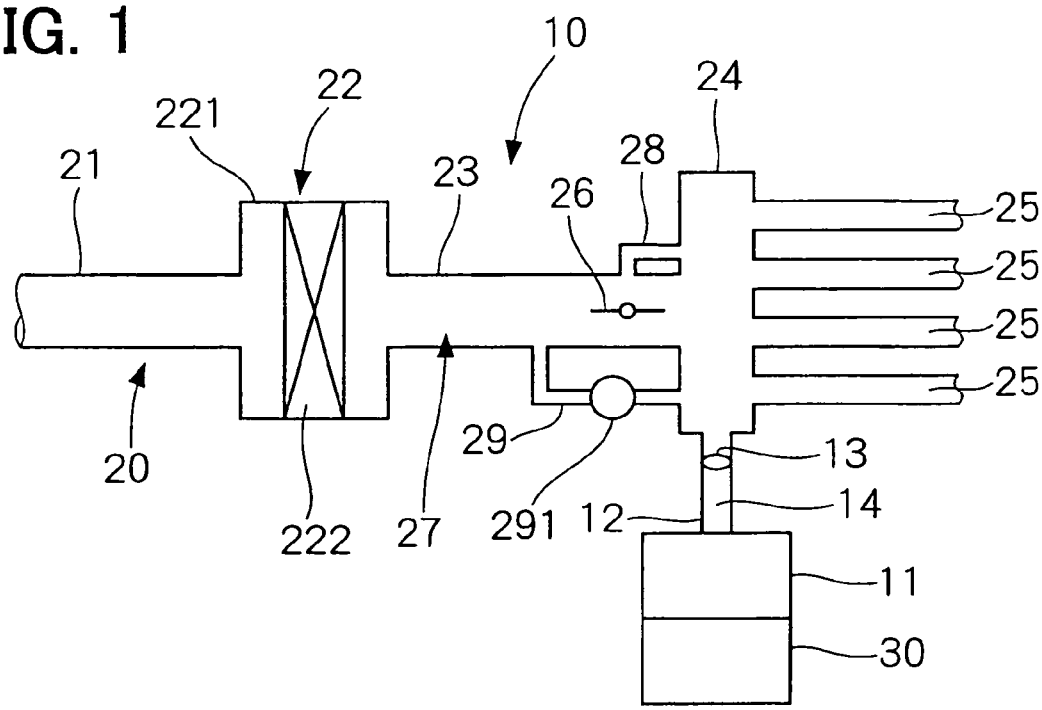
FIG. 1 is a schematic view showing an air suction device according to a first embodiment of the present invention.

Referring to FIG. 1, the air suction device 10 includes an air suction system 20, a compression pump 11, a compression air control unit 30, a connection pipe 12 and a vibration plate 13. The air suction system 20 has a first suction pipe portion 21, an air cleaner 22, a second suction pipe portion 23, a surge tank 24, multiple intake manifolds 25 and a throttle valve 26. The first suction pipe portion 21, the air cleaner 22, the second suction pipe portion 23, the surge tank 24 and the intake manifolds 25 construct an air suction passage 27 in which suction air flows.

Two ends of the first suction pipe portion 21 are respectively connected with an opening end portion (not shown) and the air cleaner 22. Air (suction air) which is sucked through the opening end portion flows into the air cleaner 22 through the first suction pipe portion 21.

The air cleaner 22 has a case portion 221 and an element 222, which is accommodated in the case portion 221 to remove foreign matter in suction air. The case portion 221 is connected with the first suction pipe portion 21 and the second suction pipe portion 23. In this case, two ends of the second suction pipe portion 23 are respectively connected with the air cleaner 22 and the surge tank 24. Suction air having passed the air cleaner 22 flows into the surge tank 24 through the second suction pipe portion 23.

The surge tank 24 is connected with the second suction pipe portion 23 and the intake manifolds 25. Two ends of the intake manifold 25 are respectively connected with the surge tank 24 and a cylinder of the engine. In this embodiment, the cylinders (e.g., totaled to four) of the engine are respectively connected with the ends of the intake manifolds 25 (e.g., totaled to four).

Suction air which is supplied through the second suction pipe portion 23 flows into the surge tank 24 and the intake manifolds 25, and is sucked into the cylinders of the engine through the intake manifolds 25.

The throttle valve 26 is arranged in the second suction pipe portion 23 to selectively open/close the air suction passage 27 formed by the second suction pipe portion 23, so as to control the flow amount of suction air which is sucked into the engine.

An idle bypass passage 28 and an ISC passage 29 are bifurcated (branched) from the second suction pipe portion 23. The idle bypass passage 28 is branched from the second suction pipe portion 23 at the opposite side (upstream side) of the throttle valve 26 to the engine, and connected with the surge tank 24. The idle bypass passage 28 is arranged so that air of a predetermined amount flows into the side of the engine when the throttle valve 26 is completely closed.

Similarly, the ISC passage 29 is branched from the second suction pipe portion 23 at the opposite side (upstream side) of the throttle valve 26 to the engine, and connected with the surge tank 24. An ISC valve 291 is arranged at the ISC passage 29 to adjust the flow amount of suction air flowing through the ISC passage 29 when the engine is at idle. Thus, air of a suitable amount corresponding to the state of the engine can be supplied for the engine, even when the engine is at idle. Therefore, the idle of the engine becomes stable.

The compression pump 11 compresses air having been sucked therein, and discharges the air into a connection passage 14 which is defined by the connection pipe 12. The compression air control unit 30 controls the pressure and the flow amount of compression air which is discharged from the compression pump 11 to the connection passage 14. Two ends of the connection pipe 12 are respectively connected with the discharged side of the compression pump 11 and the surge tank 24.

The vibration plate 13 is arranged at the connection passage 14 defined by the connection pipe 12. The vibration plate 13 can be vibration-excited by flowing air. That is, compression air discharged from the compression pump 11 will vibration-excite the vibration plate 13. The vibration of the vibration plate 13 is transmitted to suction air which flows through the surge tank 24 (being part of air suction passage 27).

Figure 2:
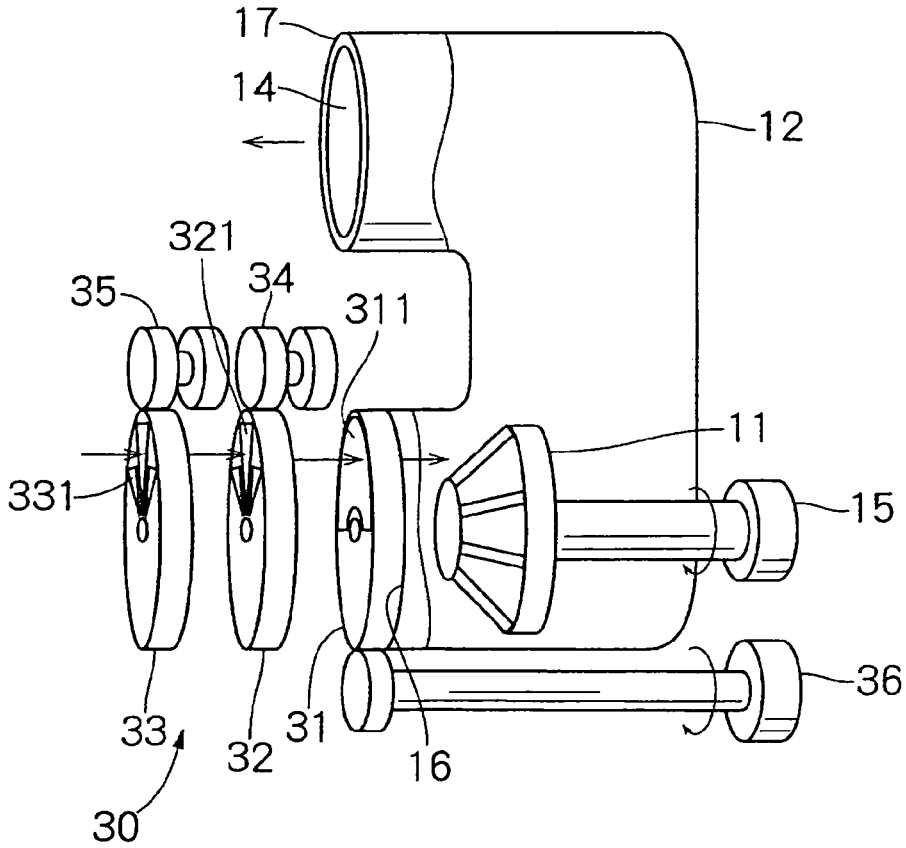
FIG. 2 is a schematic view showing a compression pump of the air suction device according to the first embodiment.

Referring to FIG. 2, the compression pump 11 is driven through a driven shaft 15 which is connected with a crank shaft or a cam shaft of the engine (not shown). Thus, the compression pump 11 can be driven in synchronization with the rotation of the engine. Alternatively, the compression pump 11 can be also constructed to be directly driven by the crank shaft or the cam shaft of the engine.

The compression pump 11 compresses air having been sucked therein from a suction portion 16, and then discharges it from a discharge portion 17. The compression air control unit 30 is arranged at the suction portion 16. The compression air control unit 30 changes the flow amount and the suction time of air which is sucked into the compression pump 11, to control the phase and amplitude of the pressure variation of compression air which is discharged from the compression pump 11.

Figure 3A:
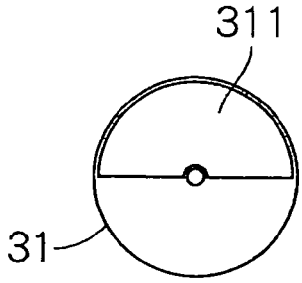
FIG. 3A is a schematic view showing a first opening member of the compression pump according to the first embodiment.

The compression air control unit 30 has a first opening member 31, a second opening member 32, a third opening member 33, an actuator 34 and an actuator 35. The first opening member 31, being arranged at the suction portion 16 of the compression pump 11, is driven (rotated) by a driving shaft 36 which is connected with a crank shaft or a cam shaft of the engine, similarly to the compression pump 11. Thus, the first opening member 31 can be driven in synchronization with the rotation of the engine. Alternatively, the first opening member 31 can be also constructed to be directly driven by the crank shaft or the cam shaft of the engine. The first opening member 31 is provided with an opening portion 311, as shown in FIG. 3A.

The second opening portion 32 is disposed at the opposite side of the first opening member 31 to the compression pump 11. The third opening member 33 is arranged at the opposite side of the second opening member 32 to the compression pump 11 and the first opening member 31. That is, at the side of the suction portion 16 of the compression pump 11, the first opening member 31, the second opening member 32, and the third opening member 33 are sequentially arranged from the adjacent side of the compression pump 11.

Figure 3B:
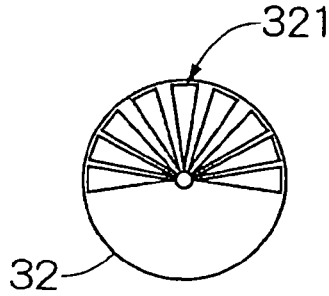
FIG. 3B is a schematic view showing a second opening member of the compression pump.

As shown in FIG. 3B, multiple slit-shaped opening portions 321 are formed at the second opening member 32. Similarly, the third opening member 33 is provided with multiple slit-shaped opening portions 331 with reference to FIG. 3C. The second opening member 32 and the third opening member 33 are respectively driven by the actuator 34 and the actuator 35. Thus, the relative rotation angle between the second opening member 32 and the third opening member 33 can be changed, so that the overlap area between the opening portion 321 and the opening portion 331 is variable.

Therefore, the flow amount of air flowing through the opening portion 321 and the opening portion 331 can be changed. The flow amount of air sucked into the suction portion 16 of the compression pump 11 can be controlled.

The first opening member 31, being arranged at the side of the compression pump 11 of the second opening member 32, is rotated through the driving shaft 36 in synchronization with the rotation of the engine. Responding to the rotation of the first opening member 31, suction air can flow to the suction portion 16 of the compression pump 11 when the opening portion 311 of the first opening member 31, the opening portions 321 of the second opening member 32 and the opening portions 331 of the third opening member 33 coincide with each other. Accordingly, the first opening member 31 controls (determines) the suction time of air which is sucked into the compression pump 11 in synchronization with the rotation of the engine.

The first opening member 31 controls the suction time of air sucked into the compression pump 11, to control the phase of the pressure variation of compression air (discharged from the compression pump 11) in synchronization with the rotation of the engine. Moreover, the second opening member 32 and the third opening member 33 are rotated to adjust the flow amount of air sucked into the compression pump 11, so that the amplitude of the pressure variation of compression air discharged from the compression pump 11 is controlled.

Compression air from the compression pump 11 is discharged to the connection passage 14, and vibration-excites the vibration plate 13 positioned at the connection passage 14. The vibration of the vibration plate 13 is transmitted to suction air in the surge tank 24 (being part of air suction passage 27).

When the engine operates, suction air in the air suction passage 27 will have a pressure variation so that suction air noise is caused. The pressure variation of suction air sucked into the engine is transmitted from the engine through the interior of the air suction passage 27 toward the opening end portion. In this case, the pressure variation of suction air which is transmitted from the side of the engine will be reflected to the side of the engine, at the surge tank 24 which is a capacity-enlarged portion of the suction passage 27. Therefore, noise caused by the pressure variation of suction air is amplified at the surge tank 24 and the vicinity thereof.

In the first embodiment, because the compression pump 11 and the first opening member 31 are synchronized with the rotation of the engine, the vibration plate 13 is excited by compression air discharged from the compression pump 11 to have vibration with an opposite phase to the pressure variation of suction air.

The vibration having the opposite phase to the pressure variation of suction air at the surge tank 24 is applied to suction air, so that noise at the air suction passage 27 is counteracted. According to this embodiment, suction air noise of the engine can be reduced in the substantially whole rotation-speed range of the engine, referring to FIG. 4.

Moreover, because the vibration is exerted to suction air flowing through the surge tank 24 to counteract the pressure variation of suction air, suction air having a stable pressure is sucked into the engine. Therefore, the pressure of suction air sucked into the engine is increased, thus improving the capacity efficiency (air-suction efficiency) of suction air which is sucked into the engine, referring to FIG. 5. Accordingly, the output of the engine in the substantially whole rotation-speed range is increased.

As described above, in the first embodiment, the vibration plate 13 is vibration-excited by compression air discharged from the compression pump 11. Thus, the pressure variation of suction air flowing through the air suction passage 27 is substantially counteracted by the vibration having the opposite phase which is caused by the vibration plate 13.

The compression air control unit 30 controls the phase and amplitude of the pressure variation of compression air discharged from the compression pump 11 in synchronization with the rotation of the engine. Therefore, the phase and amplitude of the pressure variation caused by the vibration of the vibration plate 13 can be precisely controlled to respond to the rotation of the engine. Thus, the noise of suction air at the air suction passage 27 can be reduced.

According to the first embodiment, the pressure variation of suction air is counteracted through the vibration of the vibration plate 13, so that the pressure of suction air sucked into the engine is improved. Thus, the capacity efficiency of the engine can be increased. Therefore, the output of the engine can be improved.

Moreover, the value of the vibration which is applied to suction air can be controlled responding to the operation of the engine, by controlling the vibration amplitude of the vibration plate 13. Thus, sound from the engine and the output of the engine can be controlled responding to the operation thereof. For example, when the engine is accelerated, the sound from the engine can be increased along with the increase of the output thereof. Thus, the acceleration feeling can be heightened.

In the first embodiment, the compression pump 11 is used to generate compression air which has the pressure variation with a large amplitude. Thus, the vibration amplitude of the vibration plate 13 excited by compression air becomes large. Therefore, the vibration (of vibration plate 13) having the large amplitude and opposite phase can be excited even when suction air noise at the air suction passage 27 is large, so that suction air noise can be reduced.

In the first embodiment, the vibration of the vibration plate 13 is synchronized with the rotation of the engine. Therefore, noise can be reduced in the substantially whole rotation-speed range of the engine. Moreover, the output of the engine can be improved.

Second Embodiment

Figure 6:
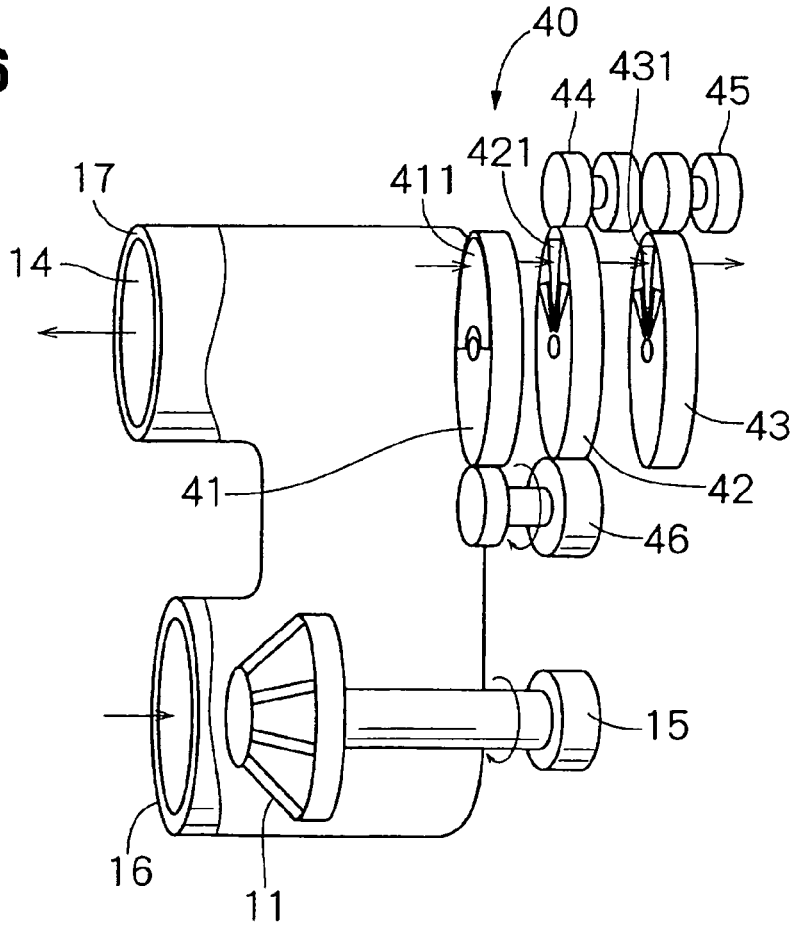
FIG. 6 is a schematic view showing a compression pump of an air suction device according to a second embodiment of the present invention.

A second embodiment of the present invention will be described with reference to FIG. 6. In this case, a compression air control unit 40 is disposed at the side of the discharge portion 17 of the compression pump 11. Part of compression air is exhausted from the compression pump 11 to atmosphere through the compression air control unit 40. Thus, the phase and the amplitude of the pressure variation of compression air discharged from the compression pump 11 to the connection passage 14, is controlled.

In the second embodiment, the compression air control unit 40 is provided with the same construction with the compression air control unit 30 of the first embodiment, while being arranged at a different position compared with the compression air control unit 30.

The compression pump 11 is driven through the driving shaft 15 which is rotated in synchronization with the engine (not shown). The compression pump 11 compresses air having been sucked therein through the suction portion 16, and discharges compression air into the connection passage 14 through the discharge portion 17.

The compression air control unit 40 has a first opening member 41, a second opening member 42, a third opening member 43, actuators 44 and 45. The first opening member 41, being arranged at the side of the discharge portion 17 of the compression pump 11, is driven (rotated) through the driving shaft 46 which is rotated in synchronization with the engine.

Figure 3C:
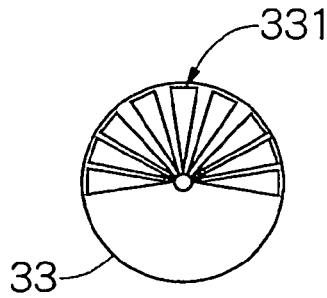
FIG. 3C is a schematic view showing a third opening member of the compression pump.
Figure 4:
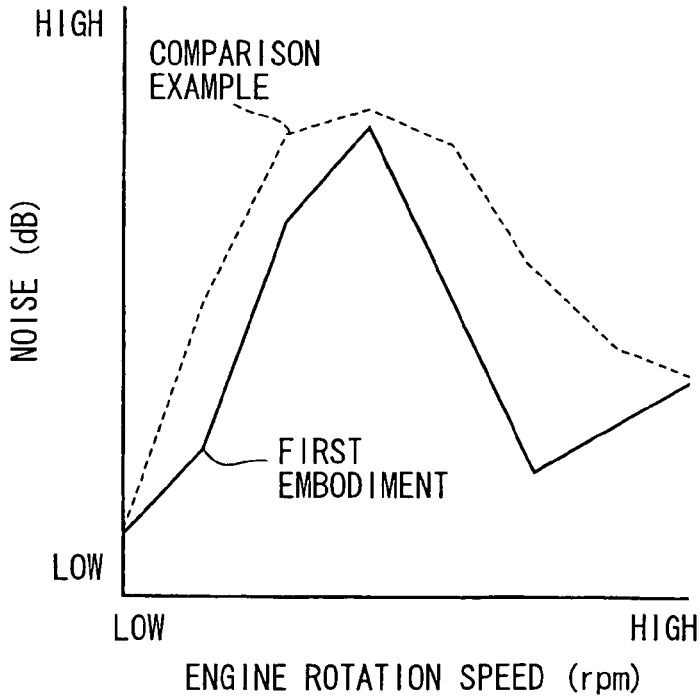
FIG. 4 is a graph showing air suction noise of the air suction device according to the first embodiment and that of an air suction device according to a comparison example.
Figure 5:
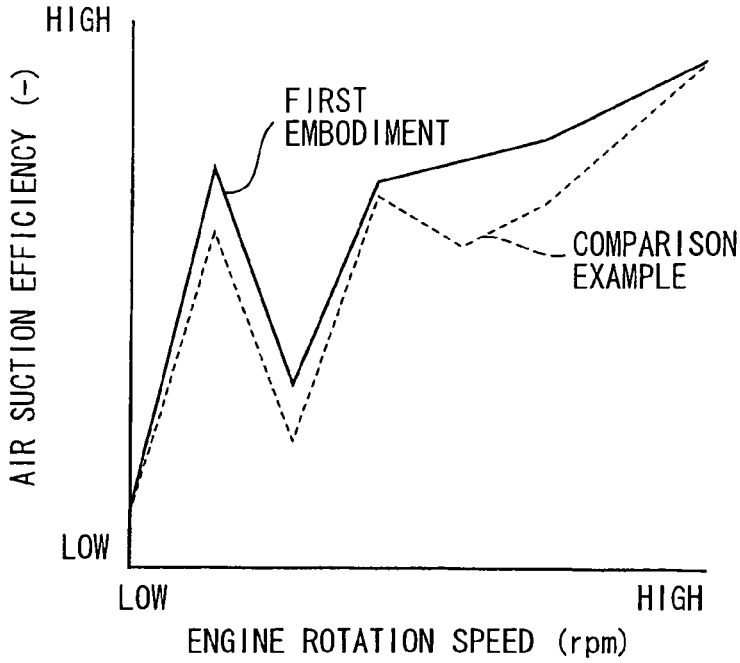
FIG. 5 is a graph showing a capacity efficiency of the air suction device according to the first embodiment and that of an air suction device according to a comparison example.

The second opening member 42 and the third opening member 43 are disposed at the opposite side of the first opening portion 41 to the compression pump 11, and respectively provided with slit-shaped opening portions 421 and 431 which respectively have the same shapes with the slit-shaped opening portions 321 and 331 shown in FIGS. 3B and 3C.

The second opening member 42 and the third opening member 43 are driven (rotated) respectively by the actuator 44 and the actuator 45. The flow amount of air discharged through the discharge portion 17 of the compression pump 11 can be controlled, by changing the relative rotation angle between the second opening member 42 and the third opening member 43.

The first opening member 41 is rotated in synchronization with the engine. Responding to the rotation of the first opening portion 41, part of compression air is exhausted to atmosphere from the side of the discharge portion 17 of the compression pump 11 when the opening portion 411 of the first opening member 41, the opening portions 421 of the second opening member 42 and the opening portions 431 of the third opening member 43 coincide with each other. The first opening member 41 controls (determines) the exhaust time of air exhausted from the compression pump 11 to atmosphere in synchronization with the rotation of the engine.

In this case, the first opening member 41 controls the exhaust time (to atmosphere) of part of compression air from the compression pump 11, to control the phase of the pressure variation of compression air which is discharged to the connection passage 14 from the compression pump 11 in synchronization with the rotation of the engine.

Moreover, the second opening member 42 and the third opening member 43 determine the exhaust flow amount (to atmosphere) of part of compression air from the compression pump 11, to control the amplitude of the pressure variation of compression air discharged to the connection passage 14 from the compression pump 11.

Compression air is discharged to the connection passage 14 from the compression pump 11, and vibration-excites the vibration plate 13 disposed at the connection passage 14. The vibration of the vibration plate 13 is transmitted to suction air in the surge tank 24 (being part of air suction passage 27).

In the second embodiment, part of compression air which is compressed in the compression pump 11 is exhausted out, so that the phase and amplitude of the pressure variation of compression air discharged to the connection passage 14 is controlled. Therefore, the vibration of the vibration plate 13 varies in synchronization with the rotation of the engine. Accordingly, noise can be reduced in the substantially whole rotation-speed range of the engine, and the output of the engine can be improved.

Third Embodiment

Figure 7:
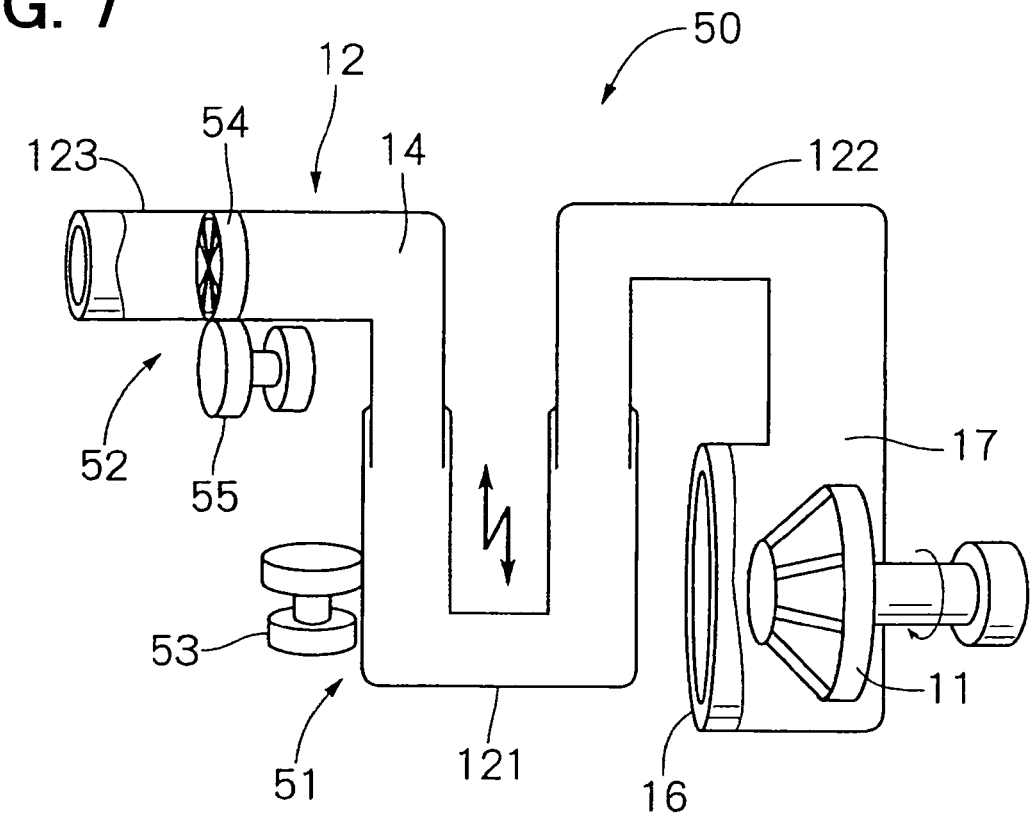
FIG. 7 is a schematic view showing a compression pump of an air suction device according to a third embodiment of the present invention.

A third embodiment of the present invention will be described with reference to FIG. 7. In this case, a compression air control unit 50 is arranged at the side of the discharge portion 17 of the compression pump 11. The compression air control unit 50 has a passage control portion 51 and an opening area control portion 52. The passage control portion 51 is provided to adjust the whole length of the connection passage 14.

In the third embodiment, the connection pipe 12 is constructed of a movable pipe 121, a first fixed pipe 122 and a second fixed pipe 123. Two ends of the first fixed pipe 122 are respectively connected with the side of the discharge portion 17 of the compression pump 11, and one end of the movable pipe 121. Two ends of the second fixed pipe 123 are respectively connected with the other end of the movable pipe 121 and the side of the surge tank 24.

In this case, the two ends of the movable pipe 121 are respectively slideably connected with the first fixed pipe 122 and the second fixed pipe 123. The movable pipe 121 can be axially (as indicated by arrow in FIG. 7) driven by an actuator 53 to move with respect to the fixed pipes 122 and 123, so that the whole length of the connection passage 14 is changed.

When the whole length of the connection passage 14 is changed, the phase of the pressure variation of compression air discharged from the compression pump 11 to the connection passage 14 is changed. Thus, when the movable pipe 121 is driven by the actuator 53 to move responding to the engine rotation speed (rpm), the phase of the pressure variation of compression air at the connection passage 14 is changed. Therefore, the vibration phase of the vibration plate 13 excited by compression air is changed.

The opening area control unit 52, being provided for the fixed pipe 123, has an opening/closing member 54 and an actuator 55. The opening/closing member 54 can be driven by the actuator 55 to adjust the opening degree of the passage of the fixed pipe 123 (being part of connection passage 14). That is, the cross section area (opening area) of the connection passage 14 can be adjusted by the opening/closing member 54 to have a predetermined value. Thus, the flow amount of compression air flowing through the connection passage 14 is controlled. Therefore, the amplitude of the pressure variation of compression air discharged from the compression pump 11 can be controlled by the opening area control unit 52.

In the third embodiment, the passage control unit 51 is provided to adjust the whole length of the connection pipe 12 where compression air having been compressed in the compression pump 11 flows. Thus, the phase of the pressure variation of compression air flowing through the connection passage 14 can be controlled. Moreover, the opening area control unit 52 is provided to change the opening area (cross section area) of the connection passage 14. Thus, the amplitude of the pressure variation of compression air flowing through the connection passage 14 can be controlled.

In this case, the whole length of the connection pipe 12 and the opening area of the connection passage 14 are changed in synchronization with the rotation of the engine. Therefore, the vibration of the vibration plate 13 varies in synchronization with the rotation of the engine. Accordingly, noise can be reduced in the substantially whole rotation-speed range of the engine, and the output of the engine can be improved.

Fourth Embodiment

Figure 8:
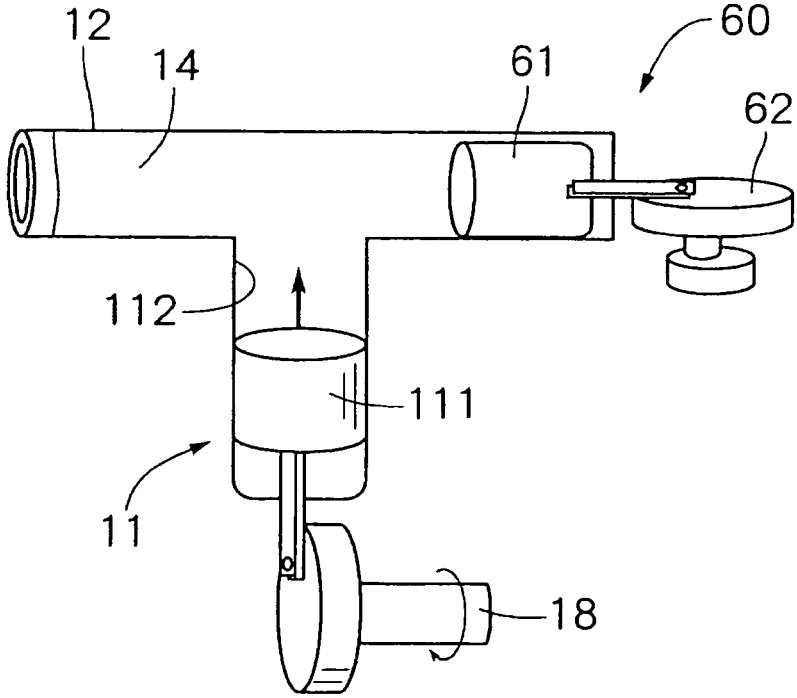
FIG. 8 is a schematic view showing a compression pump of an air suction device according to a fourth embodiment of the present invention.

A fourth embodiment of the present invention will be described with reference to FIG. 8. In this case, the compression pump 11 is a reciprocation compression pump which is provided with a cylinder 112 communicated with the connection passage 14, and a piston 111 reciprocated in the cylinder 112.

The piston 111 of the compression pump 11 is driven through a driving shaft 18 which is connected with the engine (not shown), to be reciprocated in the cylinder 112. Thus, compression air is discharged from the compression pump 11 in synchronization with the rotation of the engine.

A compression air control unit 60, being provided for the connection passage 14, has a piston 61 and an actuator 62. The piston 61 is driven by the actuator 62 to axially move in the connection passage 14, to change the capacity (volume) of the connection passage 14.

According to this embodiment, the capacity of the connection passage 14 can be changed due to movement of the piston 61 in the connection passage 14. Because the piston 61 moves in the connection passage 14 responding to the rotation of the engine, the initial pressure of compression air discharged from the compression pump 11 is changed. That is, the amplitude of the pressure variation of compression air can be changed.

In the fourth embodiment, the piston 111 of the compression pump 11 is driven in synchronization with the rotation of the engine, to cause the pressure variation of compression air discharged from compression pump 11 responding to the rotation of the engine. Thus, the phase of the pressure variation of compression air can be controlled.

Moreover, the capacity (volume) of the connection passage 14 can be changed by the piston 61 of the compression air control unit 60, so that the amplitude of the pressure variation of compression air is controlled. Therefore, vibration of the vibration plate 13 varies in synchronization with the rotation of the engine. Accordingly, noise can be reduced in the substantially whole rotation-speed range of the engine, and the output of the engine can be improved.

Fifth Embodiment

Figure 9:
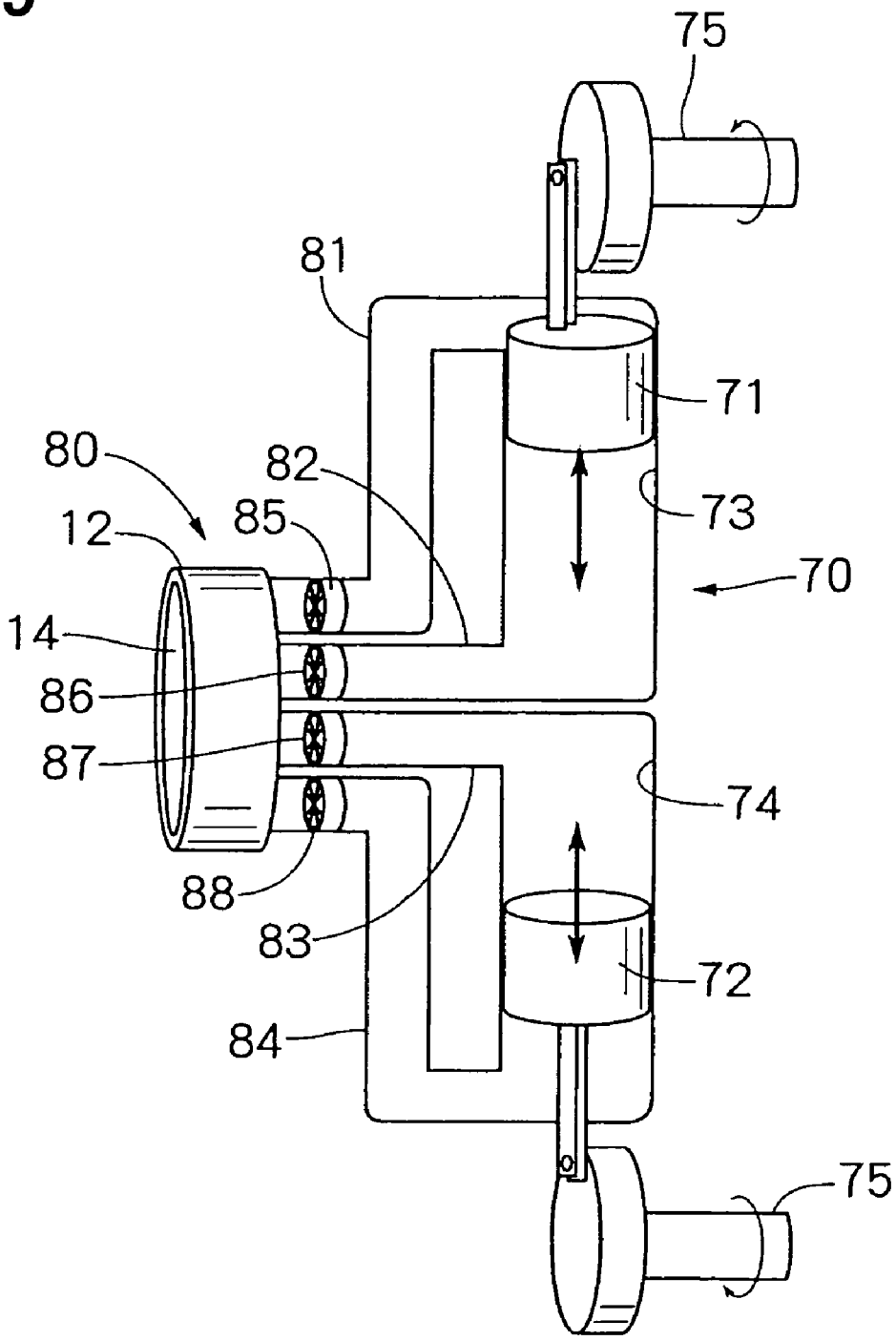
FIG. 9 is a schematic view showing a compression pump of an air suction device according to a fifth embodiment of the present invention.

A fifth embodiment of the present invention will be described with reference to FIG. 9. In this case, a compression pump unit 70 is provided with two pistons 71, 72, and two cylinders 73, 74. The pistons 71 and 72 are respectively driven through driving shafts 75 which are connected with the engine, to be axially reciprocated respectively in the cylinders 73 and 74. That is, the compression pump unit 70 includes two compression pumps, which are respectively constructed with the piston 71 and the cylinder 73, and the piston 72 and the cylinder 74.

A compression air control unit 80 is provided with discharge passages 81, 82 which are respectively connected with the two axial ends of the cylinder 73, and discharge passages 83, 84 which are respectively connected with the two axial ends of the cylinder 74. Furthermore, the compression air control unit 80 is provided with opening/closing members 85, 86, 87 and 88 which are respectively arranged in the discharge passages 81, 82, 83 and 84. The opening/closing members 85-88 are driven by actuators (not shown) to respectively adjust the opening areas (cross section areas) of the discharge passages 81-84.

Because the pistons 71 and 72 are respectively axially reciprocated in the cylinders 73 and 74, the discharge passages 81-84 are respectively provided with compression air having different pressure variation phases. For example, the pressure variations of compression air discharged to the discharge passages 81-84 can be out of phase with each other by 90°.

Compression air having the different pressure variation phases (deviated from each other by 90°, for example) from the discharge passages 81-84 is mixed at the connection passage 14. In this case, the opening areas of the discharge passages 81-84 are respectively adjustable through the opening/closing members 85-88. Therefore, compression air having arbitrary pressure variation phase and amplitude can be generated in the connection passage 14, by combining compression air passing through the discharge passages 81-84.

In this case, the pistons 71 and 72 are respectively driven through the driving shafts 75 which are connected with the engine, to be axially reciprocated respectively in the cylinders 73 and 74. Thus, the phase and amplitude of the pressure variation of compression air in the connection passage 14 can be adjusted responding to the rotation of the engine. Therefore, the vibration of the vibration plate 13 varies in synchronization with the rotation of the engine. Accordingly, noise can be reduced in the substantially whole rotation-speed range of the engine, and the output of the engine can be improved.

Sixth Embodiment

Figure 10:
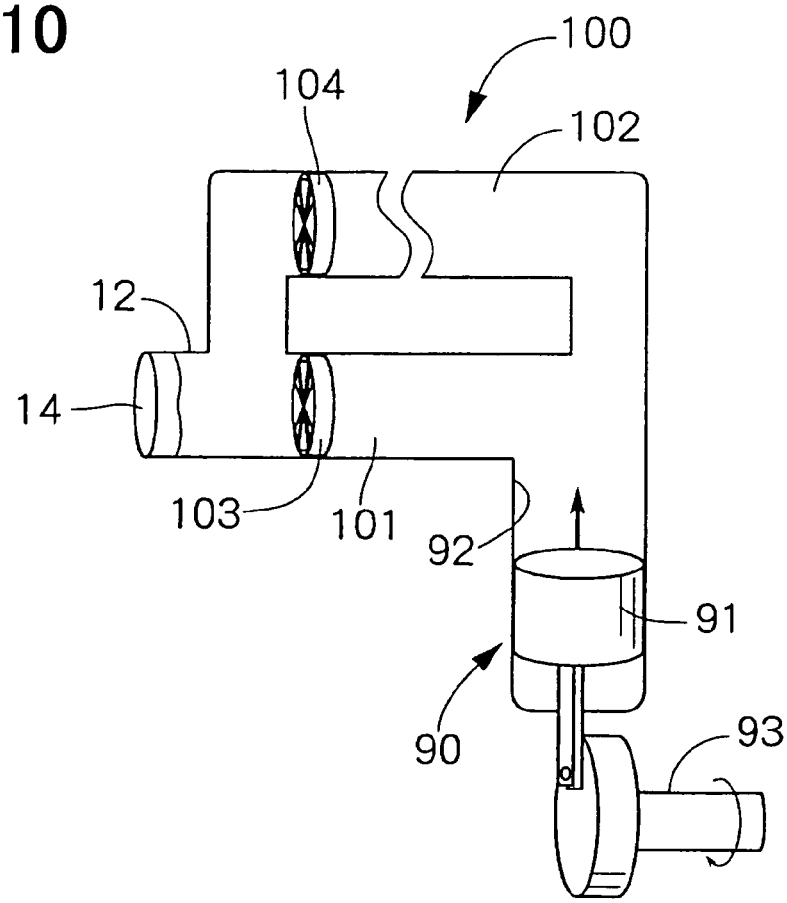
FIG. 10 is a schematic view showing a compression pump of an air suction device according to a sixth embodiment of the present invention.

A sixth embodiment of the present invention will be described with reference to FIG. 10. In this case, a compression pump 90 is provided with a cylinder 92 and a piston 91, which is driven through a driving shaft 93 to be axially reciprocated in the cylinder 92. The driving shaft 93 is connected with the engine (not shown).

A compression air control unit 100 is provided with discharge passages 101 and 102 which are connected with the cylinder 92. The whole lengths of the discharge passages 101 and 102 are different from each other. Furthermore, the compression air control unit 100 is provided with opening/closing members 103 and 104, which are respectively disposed in the discharge passages 101 and 102. The opening/closing members 103 and 104 are driven by actuators (not shown) to respectively change the opening areas (cross section areas) of the discharge passages 101 and 102.

The piston 91 is reciprocated in the cylinder 92 so that compression air is discharged to the discharge passages 101 and 102. Because the whole lengths of the discharge passages 101 and 102 are different from each other, compression air flowing into the connection passage 14 through the discharge passage 101 and that through the discharge passage 102 have different pressure variation phases from each other.

Compression air, which is discharged through the discharge passages 101 and 102 to have different pressure variation phases, is mixed in the connection passage 14. According to this embodiment, the opening areas of the discharge passages 101 and 102 are respectively adjusted through the opening/closing members 103 and 104. Thus, compression air having arbitrary pressure variation phase and amplitude can be generated in the connection passage 14, by combining compression air passing therethrough.

According to the sixth embodiment, compression air flows through the discharge passages 101 and 102 having the different whole lengths, to be provided with the different pressure variation phases. Compression air having different pressure variation phases is mixed, to adjust (control) the phase and amplitude of the pressure variation of compression air discharged to the connection passage 14 responding to the rotation of the engine.

Therefore, the vibration of the vibration plate 13 varies in synchronization with the rotation of the engine. Accordingly, noise can be reduced in the whole rotation-speed range of the engine, and the output of the engine can be improved.

In the sixth embodiment, the whole lengths of the discharge passages 101 and 102 are set different from each other, so that the pressure variation phases of compression air flowing through the discharge passages 101 and 102 become different from each other. Alternatively, the diameters or the like of the discharge passages 101 and 102 can be also set different from each other, to change the phase and amplitude of the pressure variation of compression air.

Seventh Embodiment

Figure 11:
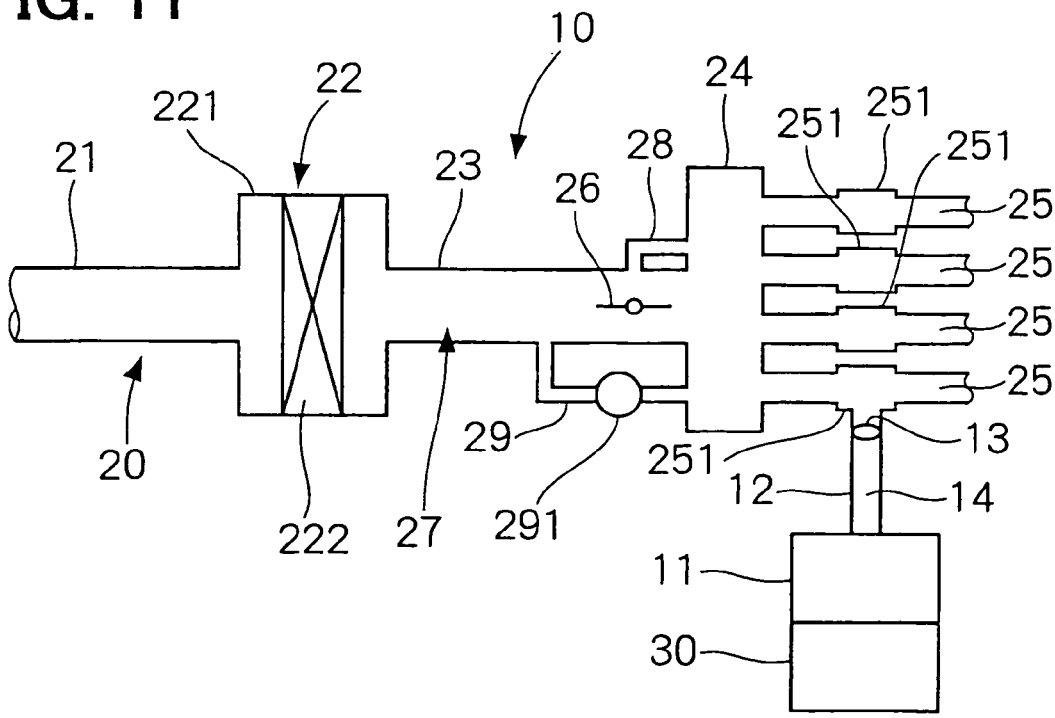
FIG. 11 is a schematic view showing an air suction device according to a seventh embodiment of the present invention.

According to a seventh embodiment of the present invention, referring to FIG. 11, the connection passage 14 is arranged at the different position in the air suction device 10 from that in the first embodiment.

In the seventh embodiment, each of the intake manifolds 25 is provided with a diameter-enlarged portion 251 (as capacity-enlarged portion) between the surge tank 24 and the engine. The end (at opposite side to compression pump 11) of the connection passage 14 is communicated with the diameter-enlarged portions 251 of all of the intake manifolds 25. Thus, the vibration of the vibration plate 13 is transmitted from the diameter-enlarged portions 251 to suction air flowing through the intake manifolds 25.

As described above, in the capacity-enlarged portion of the air suction passage 27, the pressure variation of suction air which is transmitted from the side of the engine is reflected to the side of the engine again. Therefore, noise due to the pressure variation of suction air is amplified.

According to the seventh embodiment, the connection passage 14 is connected with the diameter-enlarged portion 251 of the intake manifolds 25, and the vibration plate 13 arranged in the connection passage 14 is excited by compression air discharged from the compression pump 11 to have vibration with the opposite phase to the pressure variation of suction air. Therefore, suction air noise can be reduced, and the output of the engine is improved.

Eighth Embodiment

Figure 12:
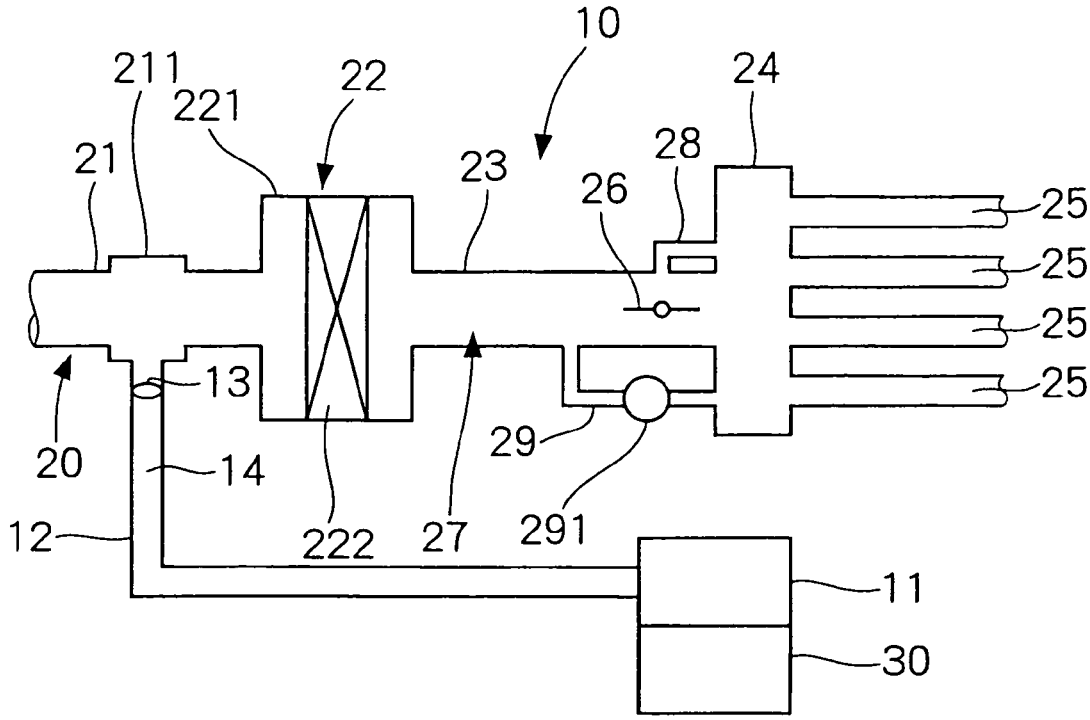
FIG. 12 is a schematic view showing an air suction device according to an eighth embodiment of the present invention.

According to an eighth embodiment of the present invention, referring to FIG. 12, the connection passage 14 is arranged at the different position in the air suction device 10 from that in the first embodiment.

In the eighth embodiment, the first suction pipe portion 21 is provided with a diameter-enlarged portion 211 (as capacity-enlarged portion) between the opening end portion and the air cleaner 22. The end (of opposite side to compression pump 11) of the connection passage 14 is connected with the diameter-enlarged portion 211.

Thus, the vibration of the vibration plate 13 is transmitted from the diameter-enlarged portion 211 of the first suction pipe portion 21 to suction air flowing through the first suction pipe portion 21. The vibration plate 13 arranged in the connection passage 14 is excited by compression air discharged from the compression pump 11 to have vibration with the opposite phase to the pressure variation of suction air. Accordingly, suction air noise can be reduced, and the output of the engine is improved.

Ninth Embodiment

Figure 13:
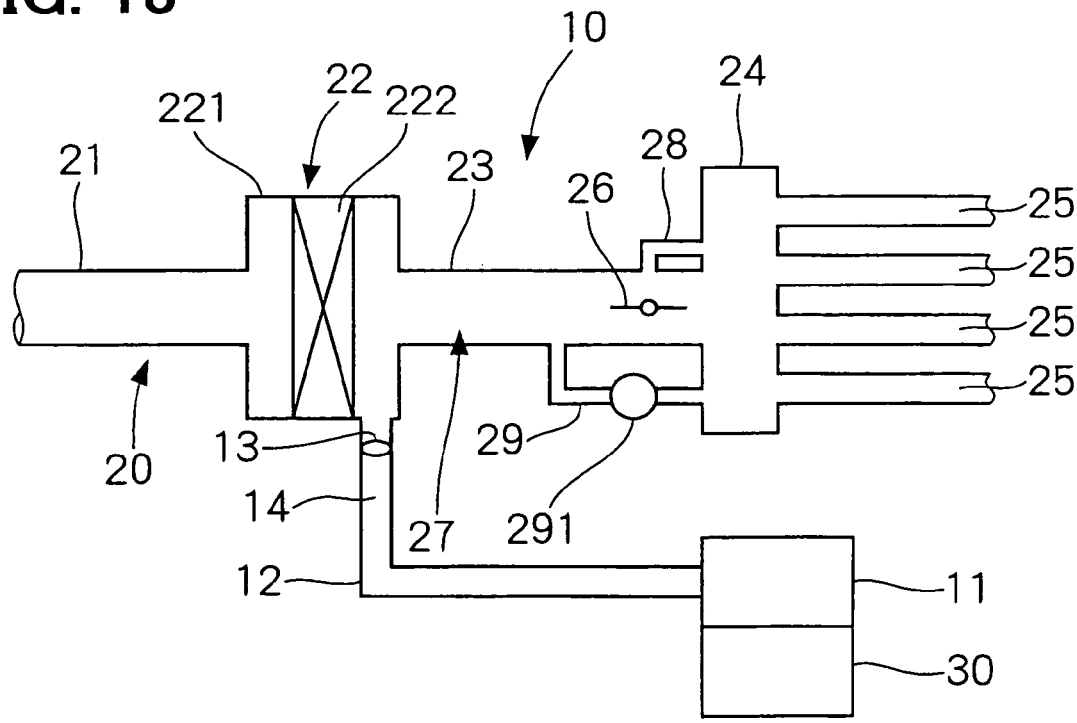
FIG. 13 is a schematic view showing an air suction device according to a ninth embodiment of the present invention.

According to a ninth embodiment of the present invention, referring to FIG. 13, the connection passage 14 is arranged at the different position in the air suction device 10 from that in the first embodiment.

In the ninth embodiment, the connection passage 14 is connected with the air cleaner 22 (as capacity-enlarged portion where air suction passage 27 is capacity-enlarged), so that the vibration of the vibration plate 13 is transmitted to suction air flowing through the air cleaner 22. The vibration plate 13 arranged in the connection passage 114 is excited by compression air discharged from the compression pump 11 to have vibration with the opposite phase to the pressure variation of suction air. Accordingly, suction air noise can be reduced, and the output of the engine is improved.

The seventh, eighth and ninth embodiments are described based on the compression pump 11 and the compression air control unit 30 described in the first embodiment. However, the compression pumps and the compression air control units described in the second-sixth embodiments can be also suitably used for the seventh, eighth and ninth embodiments.

As described in the seventh, eighth and ninth embodiments, the end (of opposite side to compression pump 11) of the connection passage 14 can be connected to any position of the capacity-enlarged portion of the suction passage 27, so that noise of suction air flowing through the air suction passage 27 is reduced and the output of the engine is improved.

What is claimed is:

1. An air suction device comprising:

an air suction system which defines an air suction passage of an internal combustion engine;

at least one capacity-enlarged portion which is positioned at midway of the air suction passage and has an enlarged capacity;

at least one compression pump which compresses air in synchronization with operation of the engine;

a compression air control unit which controls at least one of a phase and a amplitude of a pressure variation of compression air discharged from the compression pump so as to provide compression air with the pressure variation having the phase opposite to that of a pressure variation of suction air sucked into the engine; and a vibration plate which is vibration-excited by compression air from the compression pump and disposed in a connection passage of the air suction passage, the connection passage connecting a discharge side of the compression pump with the capacity-enlarged portion.

2. The air suction device according to claim 1, wherein the compression air control unit is disposed at a suction side of the compression pump to change a suction amount and a suction time of air sucked into the compression pump, so as to control the phase and the amplitude of the pressure variation of compression air discharged from the compression pump.

3. The air suction device according to claim 1, wherein the compression air control unit is disposed at the discharge side of the compression pump to change an exhaust amount and an exhaust time when part of air is exhausted to atmosphere from the compression pump, so as to control the phase and the amplitude of the pressure variation of compression air which is discharged from the compression pump.

4. The air suction device according to claim 1, wherein the compression air control unit includes:

a passage control portion which changes a length of the connection passage disposed at the discharge side of the compression pump to control the phase of the pressure variation of compression air discharged from the compression pump; and an opening area control portion which changes an opening area of the connection passage to control the amplitude of the pressure variation of compression air discharged from the compression pump.

5. The air suction device according to claim 1, wherein:

the compression pump is a reciprocation compression pump which is reciprocated in the connection passage in synchronization with the operation of the engine to compress air in the connection passage; and the compression air control unit changes a capacity of the connection passage to control the amplitude of the pressure variation of compression air in the connection passage.

6. The air suction device according to claim 1, wherein:

the two compression pumps are provided to discharge compression air having the pressure variations with the phases different from each other; and the compression air control unit controls the phase and the amplitude of the pressure variation of compression air in the connection passage, by combining compression air discharged from the two compression pumps.

7. The air suction device according to claim 1, wherein:

the compression air control unit has at least two discharge passages and distributes air compressed in the compression pump to the discharge passages; and the compression air control unit controls the phase and the amplitude of the pressure variation of compression air in the connection passage, by combining compression air which is discharged through the discharge passages to have the pressure variations with the different phases and the different amplitudes.

8. The air suction device according to claim 1, wherein:

the air suction system has a plurality of intake manifolds which are respectively communicated with cylinders of the engine, and a surge tank which distributes suction air to the intake manifolds; and the connection passage is communicated with the surge tank.

9. The air suction device according to claim 1, wherein:

the air suction system has a plurality of intake manifolds which are respectively communicated with cylinders of the engine, each of the intake manifolds being provided with a capacity-enlarged portion at midway of the intake manifold; and the connection passage is communicated with the capacity-enlarged portion of the intake manifold.

10. The air suction device according to claim 1, wherein:

the air suction system has an air cleaner for removing foreign matter in suction air flowing though the air suction passage, and a capacity-enlarged portion disposed at an opposite side of the air cleaner to the engine; and the connection passage is communicated with the capacity-enlarged portion.

11. The air suction device according to claim 1, wherein:

the air suction system has an air cleaner for removing foreign matter in suction air flowing though the air suction passage; and the connection passage is communicated with the air cleaner.

12. The air suction device according to claim 2, wherein the compression air control unit has a first opening member, a second opening member and a third opening member, each of which is rotated and provided with at least one opening, the first opening member being rotated in synchronization with rotation of the engine.

13. The air suction device according to claim 4, wherein:

the passage control portion has a movable pipe, a first fixed pipe and a second fixed pipe;

two ends of the first fixed pipe are respectively connected with a discharge portion of the compression pump and one end of the movable pipe;

two ends of the second fixed pipe are respectively connected with the other end of the movable pipe and a side of the surge tank; and the two ends of the movable pipe are respectively slideably connected with the first fixed pipe and the second fixed pipe, the movable pipe being axially driven with respect to the fixed pipes.

14. The air suction device according to claim 5, wherein the compression pump is provided with a cylinder which is communicated with the connection passage, and a piston which is reciprocated in the cylinder.

15. The air suction device according to claim 6, wherein:

each of the compression pumps includes a cylinder and a piston which is reciprocated in the cylinder; and the compression air control unit includes four discharge passages and four opening/closing members which are respectively arranged in the discharge passages to adjust opening areas of the discharge passages, compression air being discharged from the compression pumps to the connection passage through the discharge passages.

16. The air suction device according to claim 7, wherein lengths of the discharge passages are different from each other.

17. The air suction device according to claim 7, wherein diameters of the discharge passages are different from each other.

* * * * *